United States Patent [19]

Marx

[11] 4,357,737

[45] Nov. 9, 1982

[54] METHOD AND APPARATUS FOR OPENING TEXTILE FIBER BALES

[75] Inventor: Hans-Jürgen Marx, Mönchen-Gladbach, Fed. Rep. of Germany

[73] Assignee: Trützschler GmbH & Co. KG, Mönchen-Gladbach, Fed. Rep. of Germany

[21] Appl. No.: 229,137

[22] Filed: Jan. 28, 1981

Related U.S. Application Data

[63] Continuation-in-part of Ser. No. 85,476, Oct. 17, 1979, Pat. No. 4,281,437.

[30] Foreign Application Priority Data

Nov. 2, 1978 [DE] Fed. Rep. of Germany ..... 2847460

[51] Int. Cl.[3] ..... D01C 7/06

[52] U.S. Cl. ..... 19/80 R; 19/145.5; 241/101 A

[58] Field of Search ..... 19/80 R, 80 A, 811, 19/145.5; 241/101 A

[56] References Cited

U.S. PATENT DOCUMENTS

| | | | |
|---|---|---|---|
| 3,066,878 | 12/1962 | Wildbolz | 19/80 R |
| 3,101,513 | 8/1963 | Wildbolz | 19/80 R |
| 3,139,650 | 7/1964 | Diesel et al. | 19/145.5 |
| 3,170,196 | 2/1965 | Denis | 19/80 R |
| 3,458,904 | 8/1969 | Kotter et al. | 19/80 R |
| 3,663,993 | 5/1972 | Roberson | 19/80 R |
| 3,736,624 | 6/1973 | Alt et al. | 19/80 R |
| 3,846,870 | 11/1974 | Araki et al. | 19/80 R |

FOREIGN PATENT DOCUMENTS

| | | | |
|---|---|---|---|
| 1118067 | 5/1962 | Fed. Rep. of Germany . | |
| 1528453 | 4/1968 | France | 19/80 R |
| 43-16911 | 7/1968 | Japan | 19/80 R |
| 437242 | 10/1935 | United Kingdom | 241/101 A |
| 890217 | 2/1962 | United Kingdom . | |
| 1065495 | 4/1967 | United Kingdom . | |
| 2037831 | 7/1980 | United Kingdom | 19/80 R |

*Primary Examiner*—Louis Rimrodt
*Attorney, Agent, or Firm*—Spencer & Kaye

[57] ABSTRACT

An apparatus for opening fiber bales includes an opening member arranged for travel along serially arranged fiber bales to execute opening passes; a grate including parallel-spaced grate bars having an operative position in which they extend parallel to the direction of travel of the opening member and press down on an upper surface of the bales. The opening member has opening elements projecting through clearances defined between adjoining grate bars. The operative position of the grate is varied substantially in a horizontal direction transversely to the direction of travel of the opening member and relative to the opening elements, whereby ridges of bale material formed underneath the grate bars are periodically exposed.

6 Claims, 4 Drawing Figures

METHOD AND APPARATUS FOR OPENING TEXTILE FIBER BALES

CROSS-REFERENCE TO RELATED APPLICATION

This application is a continuation-in-part of application Ser. No. 85,476, filed Oct. 17, 1979, now U.S. Pat. No. 4,281,437, granted Aug. 4, 1981.

BACKGROUND OF THE INVENTION

This invention relates to a method and an apparatus for opening a plurality of textile fiber bales, particularly compressed cotton bales. The fiber is removed from the top of the bales by an opening device which comprises a spiked roll, toothed discs or the like and which projects through a grate and extends into the upper face of the fiber bales.

As a result of the operation of conventional bale opening apparatuses of the above-outlined type, the opening rolls leave, on the face of the bales, parallel grooves separated by parallel ridges; these latter, in turn, are formed in the contact (pressure) areas between the grate and the bale surface. It has been found that it is difficult to remove the fiber material from the ridge portions because the latter cannot be directly attacked by the spikes or teeth of the opening device but can be only entrained laterally by the directly removed fiber material. Further, the fiber material constituting the ridge portions are even further compressed by the pressing effect of the grate bars. Thus, it has been found that such ridges can be removed only with difficulty and only very gradually in sevral consecutive passes. This adversely affects the efficiency of the apparatus to a significant degree.

To remedy the above-discussed disadvantage, it has been known to periodically change the relative lateral position between bale and grate. Thus, in the apparatus disclosed in German Pat. No. 1,118,067, the fiber bales are periodically shifted with respect to the grate. Such shifting arrangement is disadvantageous in that the fiber bales have a substantial weight and are in general not easy to handle. Further, the opening rolls, while movable vertically, are, however, not displaceable with respect to the grate bars.

SUMMARY OF THE INVENTION

It is an object of the invention to provide an improved apparatus of the above-outlined type in which a lateral shift in the relative position between grate and bale is effected without displacing the bales, to thus avoid the disadvantages discussed above.

This object and others to become apparent as the specification progresses, are accomplished by the invention, according to which, briefly stated, the grate bars are displaceable laterally relative to the opening device.

The invention is based on the principle to expose, during fiber removal, the ridge portions appearing at the location of engagement between the grate bars and the upper bale surface in such a manner that they can be opened without difficulty during the successive pass of the bale opening device. For this purpose, it is solely the grate which is periodically shifted relative to the fiber bales and the opening device. The arrangement according to the invention is advantageous in that it is structurally much simpler to displace only the grate rather than to shift the heavy bales or the heavy opening device and also, much less force is needed for shifting the grate alone. By virtue of the periodic back-and-forth shifting of the grate bars, different zones of the upper bale surface are exposed, so that during consecutive passes no further depending of the already-present grooves will be effected; in this manner an overall uniform fiber removal from the bale is ensured.

Preferably, the grate bars are shifted horizontally in a direction transverse to the working direction of the opening device, that is, transversely to the length dimension of the apparatus to an extent which corresponds to one half the distance between two adjoining grate bars. Such a shifting operation may take place, for example, upon termination of one pass, as the opening device reaches an end of the apparatus. Then, during the consecutive pass, the opening device engages those parts of the fiber bale surface where ridges have been formed during the preceding pass. By virtue of this arrangement, the opening device works sequentially in laterally shifted positions on the upper bale surface.

A working pass may be performed in either direction of travel of the opening device. While it is preferred that the grate is shifted upon completion of a working pass, it is, however, feasible to shift the grate during the working passes. Thus, for example, the grate may be moved along a horizontal wavy path during operation of the opening device.

DESCRIPTION OF THE PREFERRED EMBODIMENT

Figure 1A:
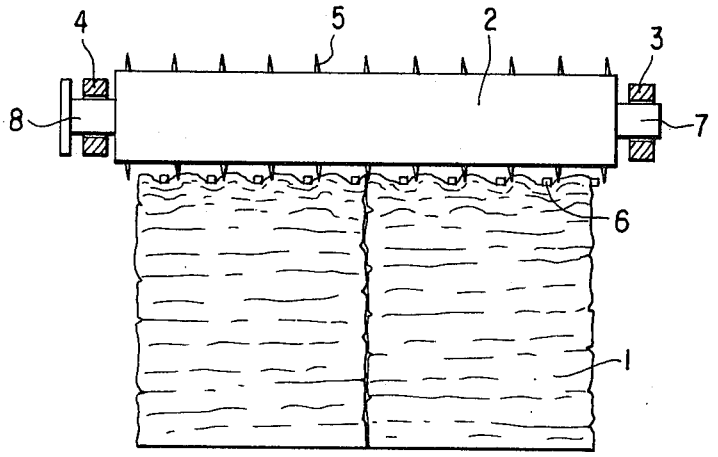
FIGS. 1*a* and 2*a* are schematic front elevational and top plan views, respectively, of a preferred embodiment of the invention, showing a component in a first operative position.
Figure 1B:
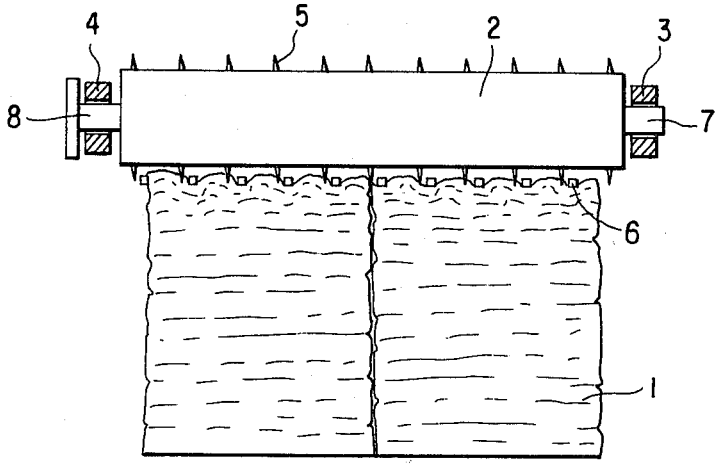
FIGS. 1*b* and 2*b* are schematic front elevational and top plan views, respectively, of the same embodiment showing a component in a second operative position.

Turning now to the Figures, there are illustrated juxtapositioned fiber bales 1 above which there is arranged an opening member, such as an opening roll 2 rotatably supported in bearings 3 and 4. The opening roll 2 has opening elements such as spikes 5 arranged to penetrate into the fiber material.

Between the opening roll 2 and the upper surface of the fiber bales 1 there is supported a grate 6 which has a plurality of parallel extending grate bars arranged to press down on the upper surface of the fiber bales. The grate bars of the grate 6 and the spikes 5 of the opening roll 2 are so arranged with respect to one another that the spikes 5 project into the fiber bale between any two adjoining grate bars.

Figure 2A:
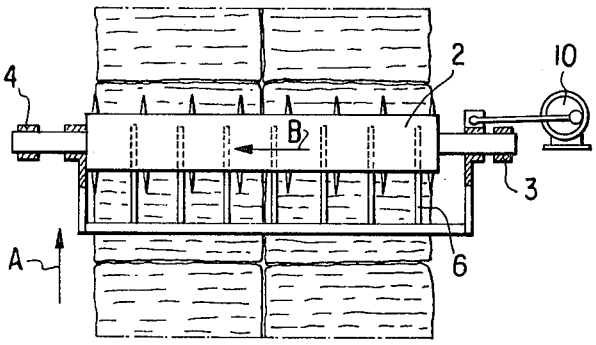

As the opening operation is in progress, during which the opening roll 2 travels in a direction parallel to the length dimension of the apparatus, for example, in the direction of arrow A in FIG. 2*a*, fiber material is removed from the fiber bales 1 by the opening elements 5 between the grate bars, so that in the surface of the fiber bales 1 parallel grooves are formed which alternate with parallel ridges. The ridges are formed where, during the opening pass, the fiber bale surface is in engagement with the bars.

Figure 2B:
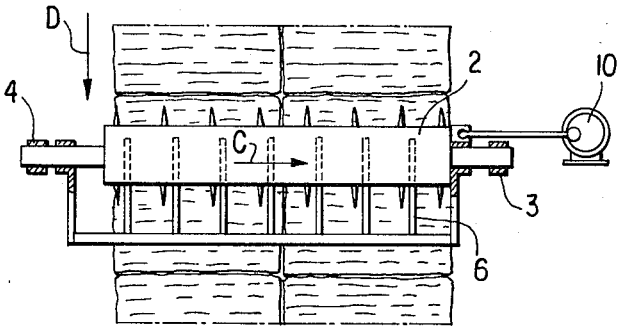

In order to ensure a uniform fiber removal, the location of engagement between the upper face of the fiber bales 1 and the grate bars is changed, for example, periodically, to thus periodically expose the ridge portions to the effect of the opening elements. For this purpose, according to the invention, the grate 6 is laterally horizontally shiftable to thus alternatingly vary the locations where the grate bars press down on the fiber bale. As seen in FIGS. 2*a* and 2*b*, the grate 6 is axially slidably mounted on the shaft 7 of the opening roll 2 and is coupled with a shifting mechanism 10 (such as a crank assembly) to change the position of the grate. The extent of displacement may be, for example, one half the distance between two adjoining bars of the grate 6.

In FIGS. 1*a* and 2*a* the grate 6 is shown in its right-hand position while FIGS. 2*a* and 2*b* show the grate 6 in its leftward shifted position. Thus, for example, the shifting operation towards the left in the direction of the arrow B may take place as the opening roll 2 reaches the end of its travel in the direction of arrow A (FIG. 2*a*) and the next shifting of the grate 6 towards the right in the direction of the arrow C may be effected at the end of the subsequent working pass performed while the opening roll travels in the direction of the arrow D (FIG. 2*b*).

It will be understood that the above description of the present invention is susceptible to various modifications, changes and adaptations and the same are intended to be comprehended within the meaning and range of equivalents of the appended claims.

What is claimed is:

1. In a method of opening fiber bales with an apparatus having a grate including parallel-spaced grate bars pressing on a surface of the bales; an opening member having opening elements projecting through the clearance defined by adjoining grate bars and penetrating into the bale for removing fibers therefrom; including the steps of propelling said opening member in back-and-forth passes above the bales relative thereto and in a direction parallel to the grate bars and to said surface of the bales; said surface being a substantially horizontally extending top surface of the bales; and maintaining the bales stationary; the improvement comprising the step of varying the position of said grate substantially in a horizontal direction transversely to the direction of back-and-forth travel of the opening member and relative to said opening member and said top surface.

2. A method as defined in claim 1, wherein the step of varying the position of said grate is performed continuously during the propelling step.

3. A method as defined in claim 1, wherein the step of varying the position of said grate is performed intermittently.

4. A method as defined in claim 3, wherein the step of varying the position of said grate is performed while a pass is in progress.

5. A method as defined in claim 3, wherein the step of varying the position of said grate is performed at the completion of a pass.

6. In an apparatus for opening fiber bales including an opening member arranged for travel along serially arranged fiber bales to execute opening passes; a grate including parallel-spaced grate bars having an operative position in which they extend parallel to the direction of travel of the opening member and press down on an upper surface of the bales; the opening member having opening elements projecting through clearances defined between adjoining grate bars; the improvement comprising means for varying the operative position of said grate substantially in a horizontal direction transversely to the direction of travel of said opening member and relative to said opening elements, whereby ridges of bale material formed underneath the grate bars are periodically exposed.

* * * * *